US010483075B2

(12) United States Patent
Masuda et al.

(10) Patent No.: US 10,483,075 B2
(45) Date of Patent: Nov. 19, 2019

(54) SLOW WAVE CIRCUIT AND TRAVELING WAVE TUBE

(71) Applicant: NEC Network and Sensor Systems, Ltd., Fuchu-shi, Tokyo (JP)

(72) Inventors: Norio Masuda, Tokyo (JP); Takashi Nakano, Tokyo (JP)

(73) Assignee: NEC NETWORK AND SENSOR SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/777,977

(22) PCT Filed: Dec. 14, 2016

(86) PCT No.: PCT/JP2016/087133

§ 371 (c)(1),
(2) Date: May 22, 2018

(87) PCT Pub. No.: WO2017/104680

PCT Pub. Date: Jun. 22, 2017

(65) Prior Publication Data

US 2018/0337016 A1 Nov. 22, 2018

(30) Foreign Application Priority Data

Dec. 18, 2015 (JP) ..... 2015-247569

(51) Int. Cl.
*H01J 23/24* (2006.01)
*H01J 25/42* (2006.01)
(Continued)

(52) U.S. Cl.
CPC ..... *H01J 23/24* (2013.01); *H01J 23/28* (2013.01); *H01J 25/42* (2013.01); *H01P 3/123* (2013.01); *H01P 11/002* (2013.01)

(58) Field of Classification Search
None
See application file for complete search history.

(56) References Cited

U.S. PATENT DOCUMENTS 2,916,657 A 12/1959 Kompfner et al.
3,221,205 A 11/1965 Sensiper
(Continued)

FOREIGN PATENT DOCUMENTS

CN 103021770 A 4/2013
JP 2011523181 A 8/2011
(Continued)

OTHER PUBLICATIONS

Gilmour: "Principles of Traveling Wave Tubes," Artech House, Inc., Book, pp. 323-357 and 362-365 (21 pages total).
(Continued)

*Primary Examiner* — Dedei K Hammond

(57) ABSTRACT

Provided are a slow wave circuit and a traveling wave tube suitable for an increase in fineness with regard to processing beam holes, and suitable for higher frequencies. A slow wave circuit (10) includes a meandering waveguide (1) and a beam hole (2) that pierces the meandering waveguide (1), and the cross-section of the beam hole (2) in the direction orthogonal to the long direction is in the shape of a polygon having a larger number of sides than a quadrilateral.

16 Claims, 12 Drawing Sheets

(51) Int. Cl.

| | |
|---|---|
| ***H01P 3/123*** | (2006.01) |
| ***H01J 23/28*** | (2006.01) |
| ***H01P 11/00*** | (2006.01) |

(56) References Cited

U.S. PATENT DOCUMENTS

| | | | | |
|---|---|---|---|---|
| 3,548,247 | A | 12/1970 | Alexeenko et al. | |
| 8,242,696 | B1 | 8/2012 | Hwu et al. | |
| 8,549,740 | B1 | 10/2013 | Hwu et al. | |
| 2012/0133280 | A1* | 5/2012 | Hwu ..... | H01J 23/24 315/3.5 |
| 2013/0200789 | A1 | 8/2013 | Baik et al. | |

FOREIGN PATENT DOCUMENTS

| | | | |
|---|---|---|---|
| JP | 2013161794 | A | 8/2013 |
| WO | 2009149291 | A2 | 12/2009 |

OTHER PUBLICATIONS

Tucek et al., "Testing of a 0.850 THz Vacuum Electronics Power Amplifier," Proceedings of 14th IEEE International Vacuum Electronics, 2013, (2 pages total).

Chinese Office Action for CN Application No. 201680074040.8 dated Jun. 27, 2019 with English Translation.

Zheng et al., "Particle-in-Cell Simulation and Optimization for a 220-GHz Folded-Waveguide Traveling-Wave Tube", IEEE Transactions on Electron Devices, IEEE Service Center, Piscataway, NJ, US, vol. 58, No. 7, Jul. 1, 2011, pp. 2164-2171, XP011367841, ISSN: 0018-9383, DOI: 10.1109/TED.2011.2145420, 8 pages total. Extended European Search Report dated Jul. 23, 2019 issued by the European Patent Office in counterpart application No. 16875657.5.

* cited by examiner

COMPARISON OF SECTIONAL SHAPE OF BEAM HOLE AND PERFORMANCE OF SLOW WAVE CIRCUIT

COMPARISON OF SHAPE OF HEXAGON AND PERFORMANCE OF SLOW WAVE CIRCUIT

SHAPE OF BEAM HOLE AND GAIN

SLOW WAVE CIRCUIT AND TRAVELING WAVE TUBE

REFERENCE TO RELATED APPLICATION

The present application is a National Stage Entry of PCT/JP2016/087133 filed on Dec. 14, 2016, which is based on and claims the benefit of the priority of Japanese Patent Application No. 2015-247569, filed on Dec. 18, 2015, the disclosures of all of which are incorporated herein in their entirety by reference.

TECHNICAL FIELD

The present invention relates to a slow wave circuit and a traveling wave tube, and more particularly to a folded waveguide type slow wave circuit and modification and performance improvement of a traveling wave tube using the same.

BACKGROUND ART

With the improvement of a bit rate of communication, a usage method to communication or the like in a higher frequency band (particularly, a terahertz wave domain) has been developed. In a frequency band more than a millimeter wave band, since output of a semiconductor device is lowered, a traveling wave tube, which is an amplification device enabling large output, is used.

A slow wave circuit is one of important components of the traveling wave tube. As the slow wave circuit of the traveling wave tube, a helix type slow wave circuit is mainly used. The helix type slow wave circuit allows an electron beam to pass through an interior of a helix type waveguide and causes interaction between a high frequency signal propagating through the waveguide and the electron beam, thereby amplifying the high frequency signal. That is, the helix type slow wave circuit includes an electron gun that generates the electron beam, a slow wave circuit that allows the electron beam and the high frequency signal to interact with each other, and a collector that captures the electron beam after the interaction is ended (a general description of the traveling wave tube, for example, is provided in Non-Patent Literature 1 (NPL1)).

When a frequency of a signal inputted to the traveling wave tube becomes high and approaches a terahertz wave band, since its wavelength becomes short, micro-fabrication of the slow wave circuit is required. However, in the helix type slow wave circuit, components having a three-dimensional structure are assembled in a structure called an integrated pole piece (IPP). The helix is supported and fixed by a support rod of a dielectric and a permanent magnet is further provided, so that a periodic magnetic field device is formed. It is difficult to high accurately assemble the helix, which has come to be micro-fabricated with a high frequency, by using a complicated structure such as the IPP.

Thus, in the terahertz wave band, a folded waveguide type slow wave circuit is used. This is because the folded waveguide type slow wave circuit is suitable to be manufactured by a micro electro mechanical systems (MEMS) manufacturing technology or a lithography technology. The folded waveguide type slow wave circuit is achieved by a combination of a folded waveguide, through which a high frequency passes, and a beam hole through which an electron beam passes.

The sectional shape of the beam hole of the folded waveguide type slow wave circuit is ideally a circle. The circular beam hole can be easily manufactured in precise machining in the folded waveguide type slow wave circuit used in a low frequency band. Normally, a slow wave circuit is divided and is subjected to machining and assembling, so that a folded waveguide type slow wave circuit is completed (NPL1).

As a frequency increases from a microwave to a terahertz wave, a wavelength is shortened. Accordingly, micro-fabrication of a waveguide is required. However, it is difficult to employ a machining technology as a manufacturing technology for micro-fabrication of a folded waveguide. In this regard, manufacturing using a lithography technology or the like is performed (Patent Literature 1 (PTL1)).

As a representative fine processing technology used for manufacturing the folded waveguide, there is a lithographie galvanoformung abformung (LIGA) technology using UV light or X ray (synchrotron light) used in MEMS manufacturing.

In the case of forming a circular section beam hole by using such a fine processing technology, since the number of manufacturing masks increases in order to reliably reproduce a curve and a manufacturing process is complicated, there is a disadvantage of yield deterioration or the like. Therefore, in a background art, the folded waveguide type slow wave circuit is manufactured in which the sectional shape of the beam hole is designed as a quadrilateral (Non-Patent Literature 2 (NPL2)).

CITATION LIST

Patent Literature

[PTL1] U.S. Pat. No. 8,549,740

Non-Patent Literature

[NPL1] Gilmour: "Principles of Traveling Wave Tubes," Artech House, Inc.

[NPL2] "Testing of a 0.850 THz Vacuum Electronics Power Amplifier," Proceedings of 14th IEEE International Vacuum Electronics Conference, 2013.

SUMMARY OF INVENTION

Technical Problem

However, the aforementioned folded waveguide type slow wave circuit has following issues. In general, when an electron beam propagates through a beam hole, the electron beam has a tendency to spread such that a beam diameter increases by charge existing in electrons itself. Therefore, a traveling wave tube generates a magnetic field by a periodic magnetic field device using a permanent magnet or the like, thereby suppressing the spread of the electron beam.

However, when the sectional shape of the beam hole of the folded waveguide type slow wave circuit is a quadrilateral, a distribution of an electric field is not uniform in a space around the apexes of the quadrilateral, thereby affecting convergence of the electron beam. When the sectional area of the quadrilateral beam hole is allowed to increase and the electron beam is allowed to pass through only the vicinity of the center part of the beam hole, it is possible to reduce an influence of an electric field in the vicinity of the apexes of the beam hole. This represents that the beam hole allowing the electron beam to pass therethrough does not become small with an increase in frequency.

On the other hand, when a frequency becomes high, since a part of the folded waveguide is allowed to follow a scaling side and becomes fine, a dimensional ratio of a beam hole crossing the folded waveguide increases and thus a margin of a dimension design is reduced. Thus, high dimensional accuracy is required. Moreover, a frequency band, in which an electron beam and a high frequency interact with each other, becomes narrow, resulting in narrowness of a frequency band in which a traveling wave tube performs amplification.

An object of the present invention is to provide a slow wave circuit and a traveling wave tube suitable for an increase in fineness with regard to processing beam holes and suitable for higher frequencies.

Solution to Problem

To achieve the above-mentioned object, a slow wave circuit according to a present invention includes: a meandering waveguide; and a beam hole that pierces the meandering waveguide, wherein a sectional shape of the beam hole in a direction orthogonal to a longitudinal direction thereof is a polygon having a larger number of sides as compared with a quadrilateral.

A traveling wave tube according to a present invention includes: an electron gun that generates an electron beam; the slow wave circuit allowing the electron beam and a high frequency signal to interact with each other; and a collector that captures the electron beam after interaction is ended, wherein the slow wave circuit comprises a meandering waveguide and a beam hole that pierces the meandering waveguide, and wherein a sectional shape of the beam hole in a direction orthogonal to a longitudinal direction thereof is a polygon having a larger number of sides as compared with a quadrilateral.

Advantageous Effect of Invention

According to the present invention, it is possible to provide a slow wave circuit and a traveling wave tube suitable for higher frequencies while facilitating fineness of a beam hole.

DESCRIPTION OF EMBODIMENTS

Preferred example embodiments of the present invention will be described in detail with reference to the drawings.

First Example Embodiment

Figure 1:
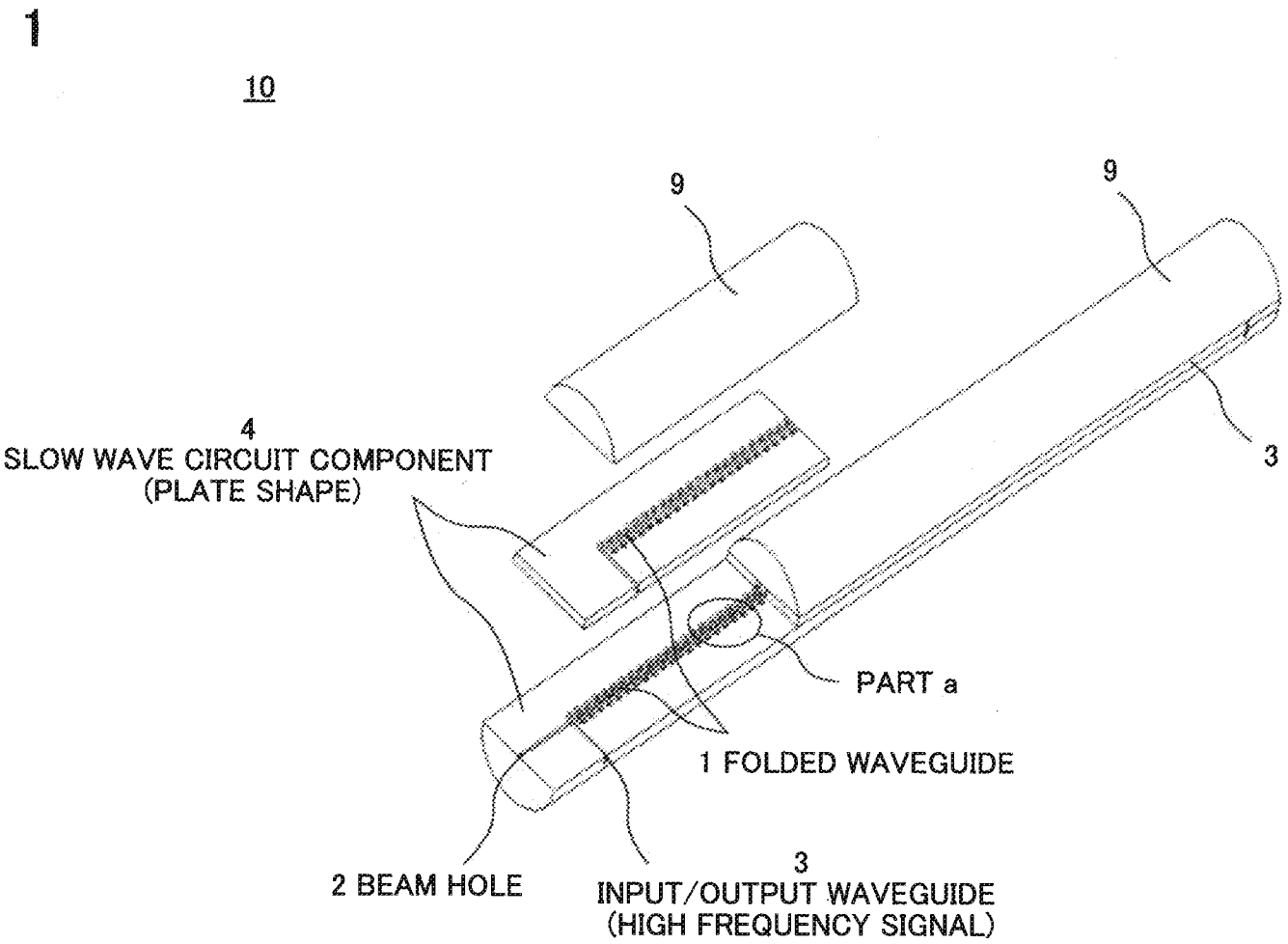
FIG. 1 is an exploded perspective view for explaining a folded waveguide type slow wave circuit according to one embodiment of the present invention.
Figure 2:
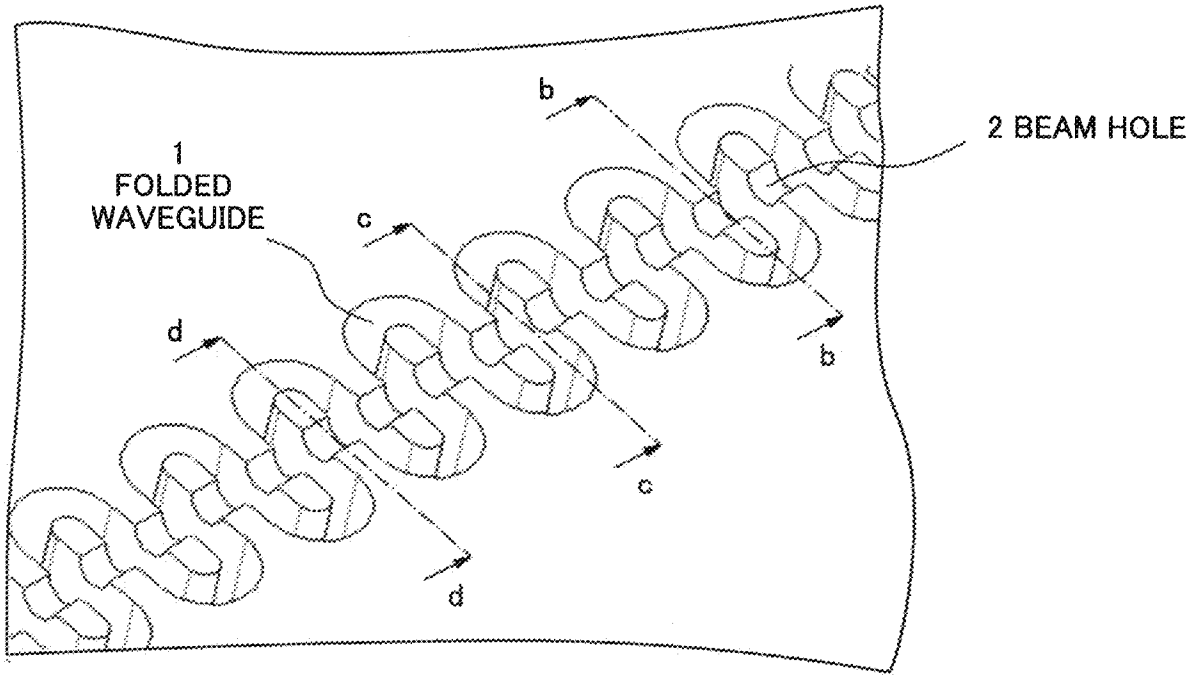
FIG. 2 is an enlarged view of a part a of a slow wave circuit component of FIG. 1.
Figure 3A:
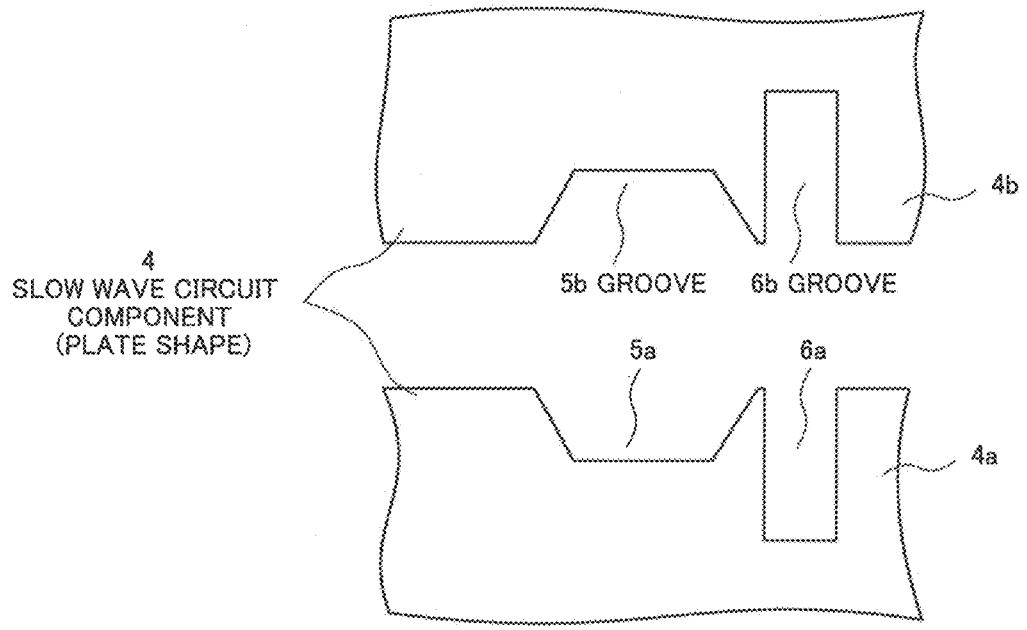
FIG. 3A is an exploded sectional view for explaining a configuration of the slow wave circuit component of one embodiment of the present invention.
Figure 3B:
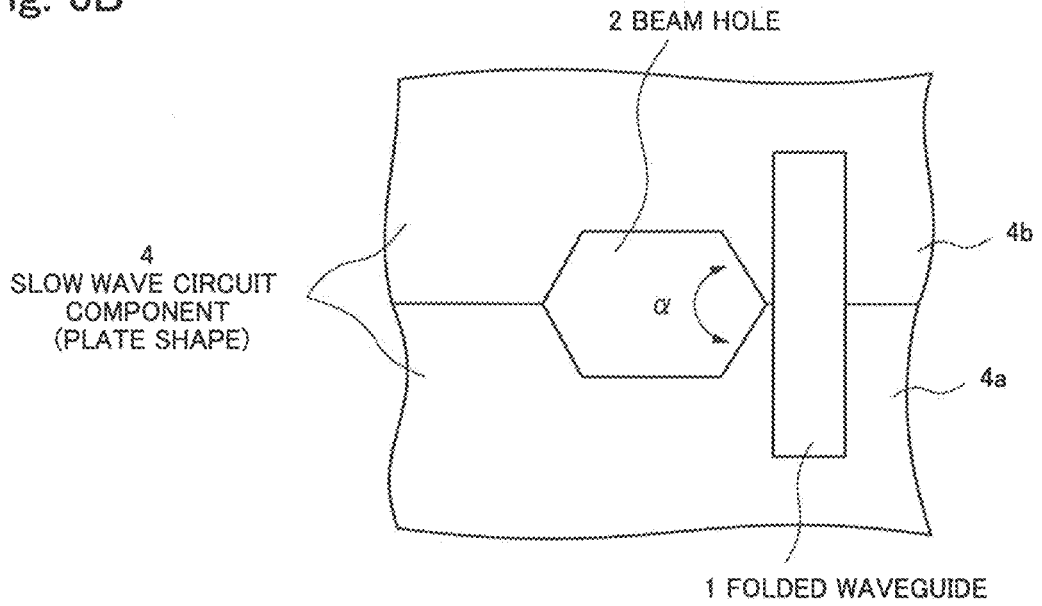
FIG. 3B is a sectional view for explaining an interior angle α of a beam hole of the slow wave circuit component of one embodiment of the present invention.
Figure 6:
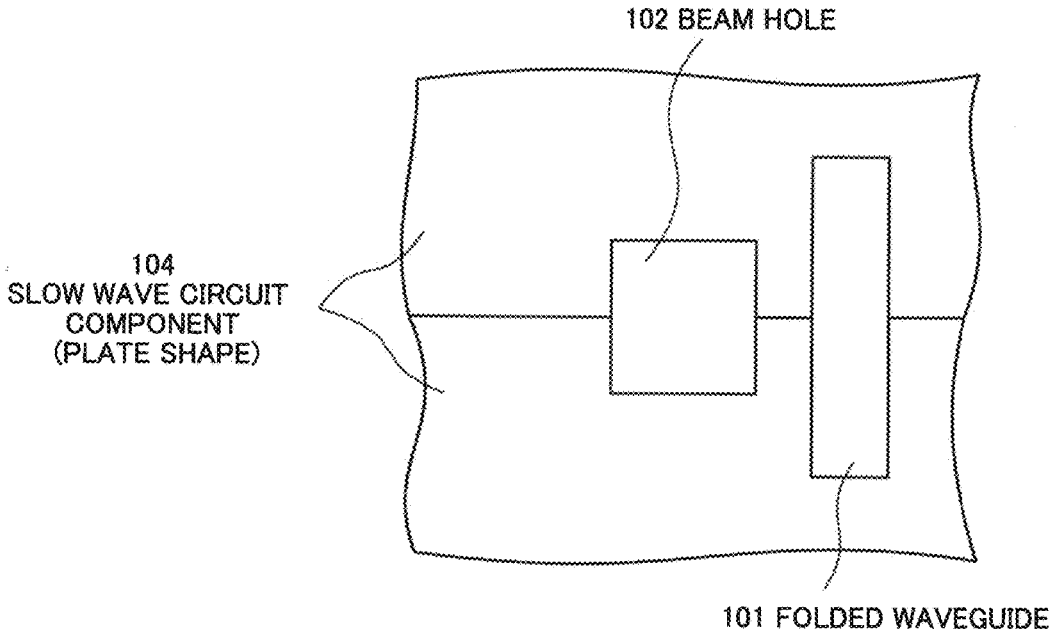
FIG. 6 is a sectional view of a slow wave circuit component of a comparative example.

A folded waveguide type slow wave circuit and a traveling wave tube according to one embodiment of the present invention will be described. FIG. 1 is an exploded perspective view for explaining a folded waveguide type slow wave circuit according to one embodiment of the present invention. FIG. 2 is an enlarged view of a part of a slow wave circuit component of FIG. 1. FIG. 3A is an exploded sectional view for explaining a configuration of the slow wave circuit component of one embodiment of the present invention, and FIG. 3B is a sectional view for explaining an interior angle α of a beam hole of the slow wave circuit component of one embodiment of the present invention. FIG. 6 is a sectional view of a slow wave circuit component of a comparative example.

(Configuration)

FIG. 1 illustrates an example of a folded waveguide type slow wave circuit 10 and a case where a plurality of components are assembled to configure the folded waveguide type slow wave circuit 10. A folded waveguide 1 and a beam hole 2 are formed in plate-like slow wave circuit components 4. Two slow wave circuit components 4 are assembled to each other by overlapping manner, so that they can serve as a folded waveguide type slow wave circuit. Moreover, semicircular components 9 are allowed to interpose the plate-like slow wave circuit components 4 therebetween, thereby constituting the folded waveguide type slow wave circuit 10 having a cylindrical shape on the whole. The folded waveguide type slow wave circuit 10 is inserted into a periodic permanent magnet of a traveling wave tube to be described later.

In the folded waveguide type slow wave circuit 10, a high frequency signal is introduced to the folded waveguide 1 from an input/output waveguide 3 and an electron beam is allowed to pass through the beam hole 2, so that an interaction occurs between the high frequency signal propagating through the folded waveguide 1 and the electron beam. A traveling wave tube amplifies the high frequency signal by the interaction.

The folded waveguide type slow wave circuit 10 of the present embodiment is a folded waveguide type slow wave circuit and includes the folded waveguide 1 as an example of a meandering waveguide and the beam hole 2 piercing the folded waveguide 1. In the folded waveguide type slow wave circuit 10 of the present embodiment, a sectional shape of the beam hole 2 in a direction orthogonal to a longitudinal direction thereof is a polygon having a larger number of sides than that of a quadrilateral.

(Advantageous Effect)

By designing the sectional shape of the beam hole 2 in the direction orthogonal to the longitudinal direction thereof to be a polygon having a larger number of sides than that of a quadrilateral, it is possible to improve the performance of the slow wave circuit as compared with a case where the sectional shape of the beam hole is a quadrilateral.

(More Detailed Configuration)

Hereinafter, a detailed description will be provided for a specific example of the polygon, in which its sectional shape has a larger number of sides than that of a quadrilateral, and an arrangement thereof. FIG. 2 illustrates an example of the beam hole 2 generated by a UV LIGA technology or the like. As illustrated in FIG. 2, the folded waveguide 1 as a meandering groove is formed on a surface of the slow wave circuit component, and the beam hole 2 is formed as a linear groove so as to pierce the folded waveguide 1.

As illustrated in FIG. 3B, in the beam hole 2 of the folded waveguide type slow wave circuit 10 of the present embodiment, the sectional shape of the beam hole 2 in the direction orthogonal to the longitudinal direction thereof is a hexagon as an example of the polygon having a larger number of sides than that of the quadrilateral. Note that, FIG. 3B illustrates an example in which the folded waveguide type slow wave circuit 10 is manufactured by a plurality of divided plate-like components; however, when a LIGA technology is used, a plurality of plate-like components can be integrally formed with each other without division.

The folded waveguide type slow wave circuit 10 of FIG. 3B includes a pair of plate-like slow wave circuit components 4. The plate-like slow wave circuit component 4 includes a plate-like slow wave circuit component 4*a* and a plate-like slow wave circuit component 4*b* as illustrated in FIG. 3B. The plate-like slow wave circuit component 4*a* is formed with a linear groove 5*a* serving as the beam hole 2 and a meandering groove 6*a* serving as the folded waveguide 1. The plate-like slow wave circuit component 4*b* is formed with a linear groove 5*b* serving as the beam hole 2 and a meandering groove 6*b* serving as the folded waveguide 1. In the folded waveguide type slow wave circuit 10 of the present embodiment, the pair of groove 5*a* of the slow wave circuit component 4*a* and the groove 5*b* of the slow wave circuit component 4*b* overlap each other, thereby constituting the beam hole 2 having a sectional hexagonal shape in the direction orthogonal to the longitudinal direction. In the folded waveguide type slow wave circuit 10 of the present embodiment, the pair of groove 6*a* of the slow wave circuit component 4*a* and the groove 6*b* of the slow wave circuit component 4*b* overlap each other, thereby constituting the folded waveguide 1 having a meandering shape.

Figure 4A:
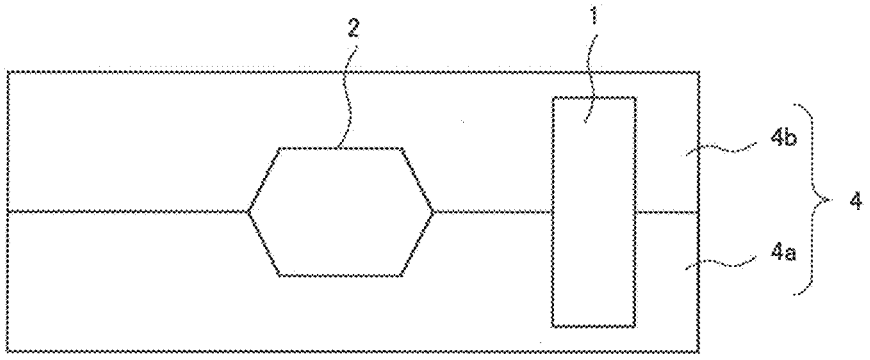
FIG. 4A is a sectional view of the slow wave circuit component of FIG. 2 taken along line b-b.
Figure 4B:
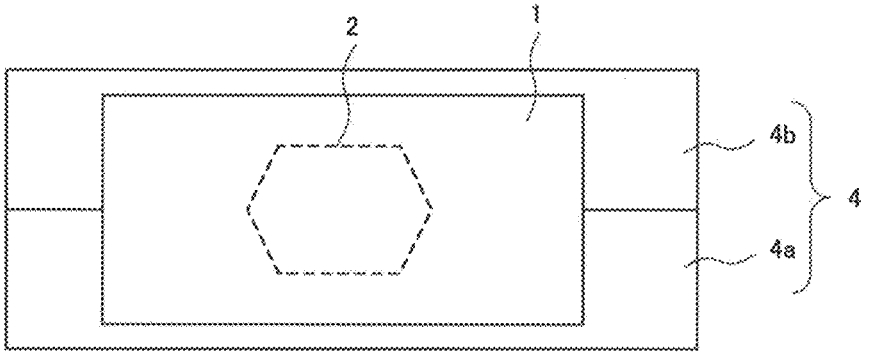
FIG. 4B is a sectional view of the slow wave circuit component of FIG. 2 taken along line c-c.
Figure 4C:
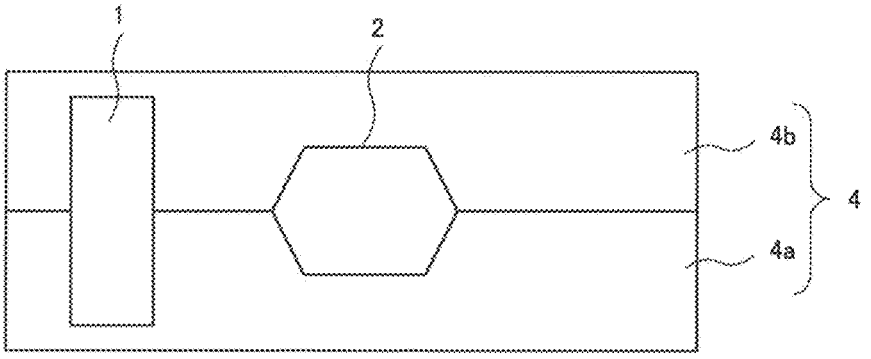
FIG. 4C is a sectional view of the slow wave circuit component of FIG. 2 taken along line d-d.

As illustrated in FIG. 3B, in the beam hole 2 of the folded waveguide type slow wave circuit 10 of the present embodiment, the hexagon is formed such that apexes of the diagonal are positioned in a direction in which the folded waveguide 1 crosses the beam hole 2. FIG. 4A is a view illustrating a section of the assembled plate-like slow wave circuit component of FIG. 2 along line b-b, FIG. 4B is a view illustrating a section of the assembled plate-like slow wave circuit component along line c-c, and FIG. 4C is a view illustrating a section of the assembled plate-like slow wave circuit component along line d-d.

Figure 5A:
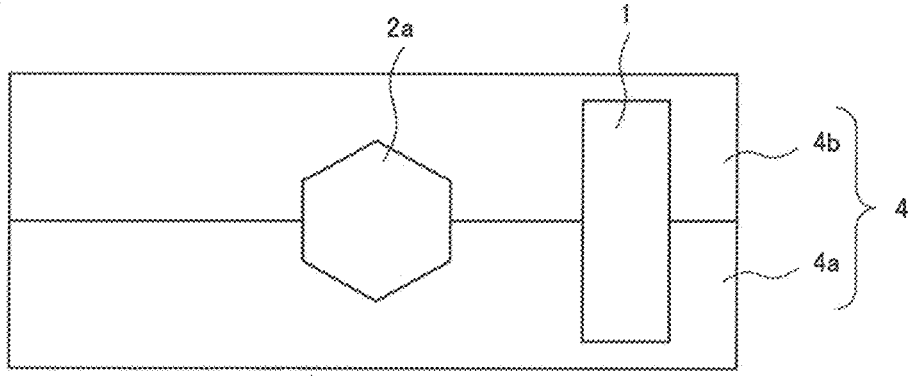
FIGS. 5A to 5C are sectional views for explaining modification examples of a sectional shape of the beam hole of the slow wave circuit component of the embodiment of the present invention.
Figure 5B:
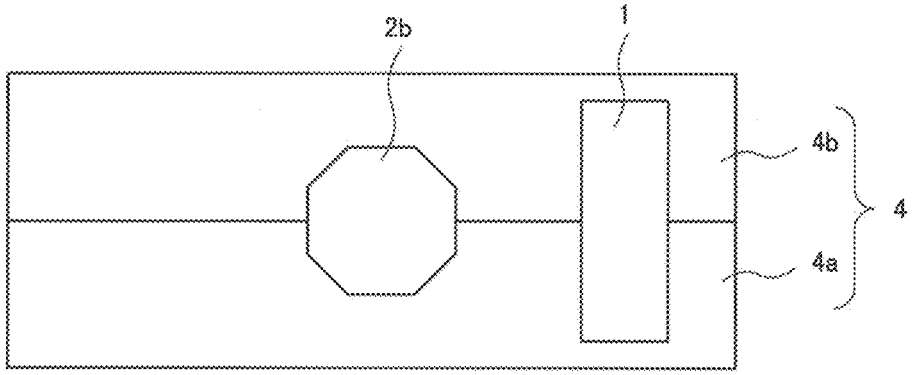
Figure 5C:
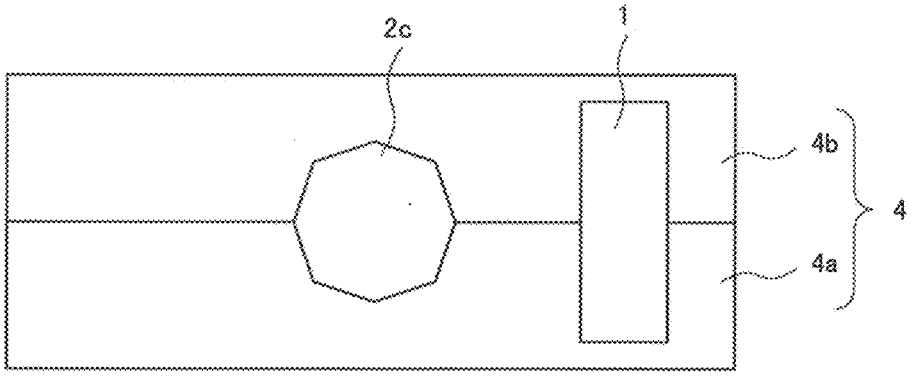

In relation to the case where the sectional shape of the beam hole 2 is a polygon having a larger number of sides than that of a quadrilateral, other shapes and arrangements are also considered as well as the shape and the arrangement illustrated in FIG. 3B. FIG. 5A to FIG. 5C are sectional views for explaining modification examples of the sectional shape of the beam hole of the slow wave circuit component of the embodiment of the present invention.

FIG. 5A illustrates a case where the sectional shape of the beam hole is a regular hexagon. In FIG. 5A, the regular hexagon is formed such that sides are positioned in a direction in which the folded waveguide 1 crosses the beam hole 2*a*.

FIG. 5B and FIG. 5C illustrate a case where the sectional shape of the beam hole is an octagon, particularly, a regular octagon. In FIG. 5B, the regular octagon is formed such that sides are positioned in a direction in which the folded waveguide 1 crosses the beam hole 2*b*. In FIG. 5C, the regular octagon is formed such that apexes of the diagonal are positioned in a direction in which the folded waveguide 1 crosses the beam hole 2*c*.

In the embodiment of the present invention, in order to avoid that an electric field distribution in an area where an electron beam passes a beam hole is asymmetric, a polygon having line symmetry is selected as the aforementioned polygon having a larger number of sides than that of a quadrilateral.

Note that, in the case where the two plate-like slow wave circuit components 4 are manufactured by the LIGA manufacturing technology or the like as illustrated in FIG. 3B and FIG. 5A, when the hexagon is arranged such that apexes of the diagonal are positioned in an up and down direction as illustrated in FIG. 5A, since the depth of the grooves of the slow wave circuit components 4 is deep in the vicinity of the apexes, manufacturing becomes difficult as compared with the arrangement of FIG. 3B. Consequently, in the case where the sectional shape of the beam hole is configured as the hexagon, it is more advantageous such that the apexes are arranged in the transverse direction as illustrated in FIG. 3B.

In relation to the shape and the arrangement of the polygon which is the sectional shape of the beam hole 2 and has a larger number of sides than that of a quadrilateral, when employing the shape and the arrangement of a polygon in which the sectional shape of the beam hole 2 is line symmetric in a first direction and is line symmetric in a second direction different from the first direction, manufacturing is facilitated. More specifically, in terms of a manufacturing difficulty level, it is preferable to employ a sectional shape and an arrangement in which the sectional shape is line symmetric in an up and down direction as an example of the aforementioned first direction and is line symmetric in a right and left direction as an example of the aforementioned second direction. Specifically, the sectional shape of the beam hole 2 having such a line symmetry is the hexagonal beam hole 2 as illustrated in FIG. 3B and the octagonal beam hole 2*b* as illustrated in FIG. 5B.

In consideration of a manufacturing difficulty level and the symmetry of an electric field distribution in an area where an electron beam passes a beam hole, the shape and the arrangement of the hexagon as illustrated in FIG. 3B are preferable. Among polygons having a larger number of sides than that of a quadrilateral, a hexagon has the smallest number of sides. When the number of sides is small, since manufacturing is facilitated, it can be understood that a hexagon has an advantage.

Figure 7:
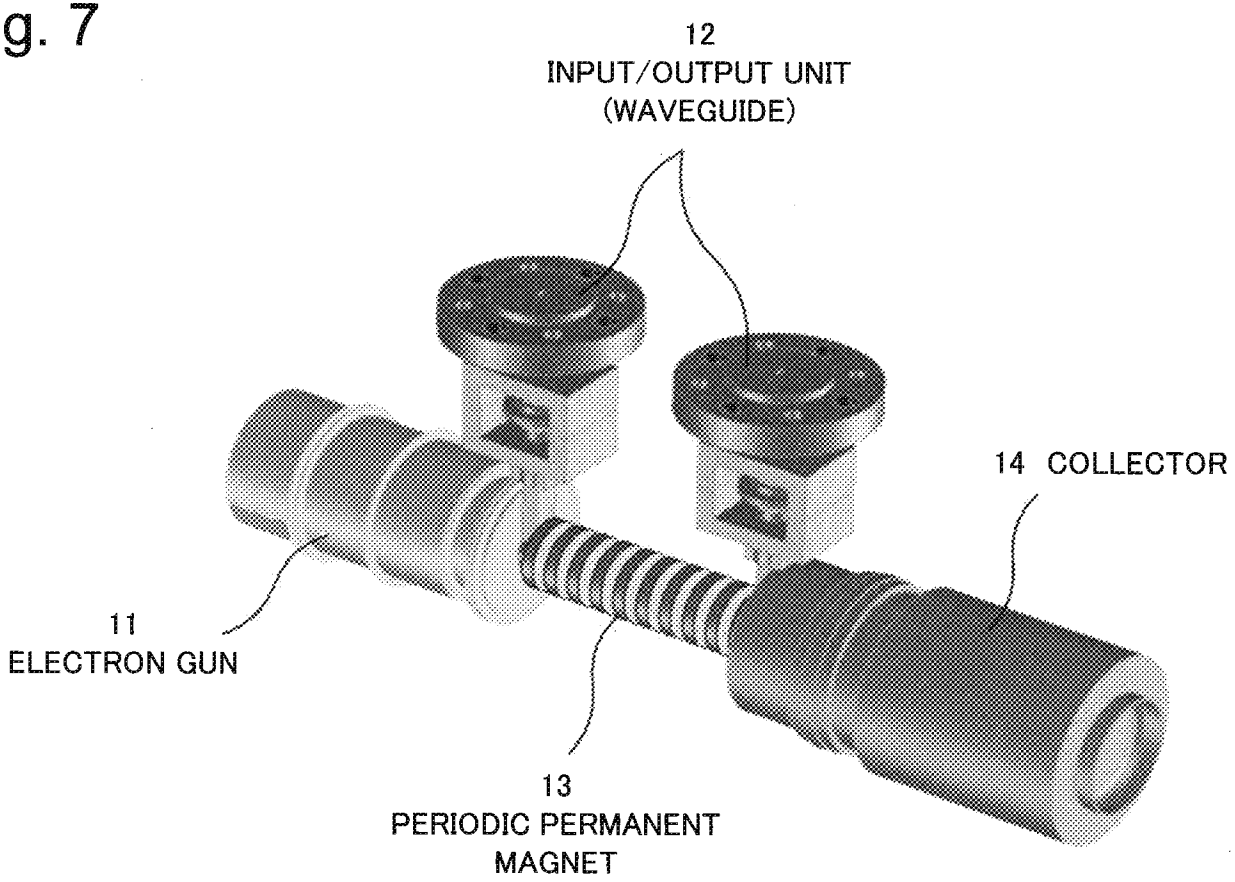
FIG. 7 is an overview diagram for explaining a traveling wave tube using the folded waveguide type slow wave circuit according to one embodiment of the present invention.
Figure 8:
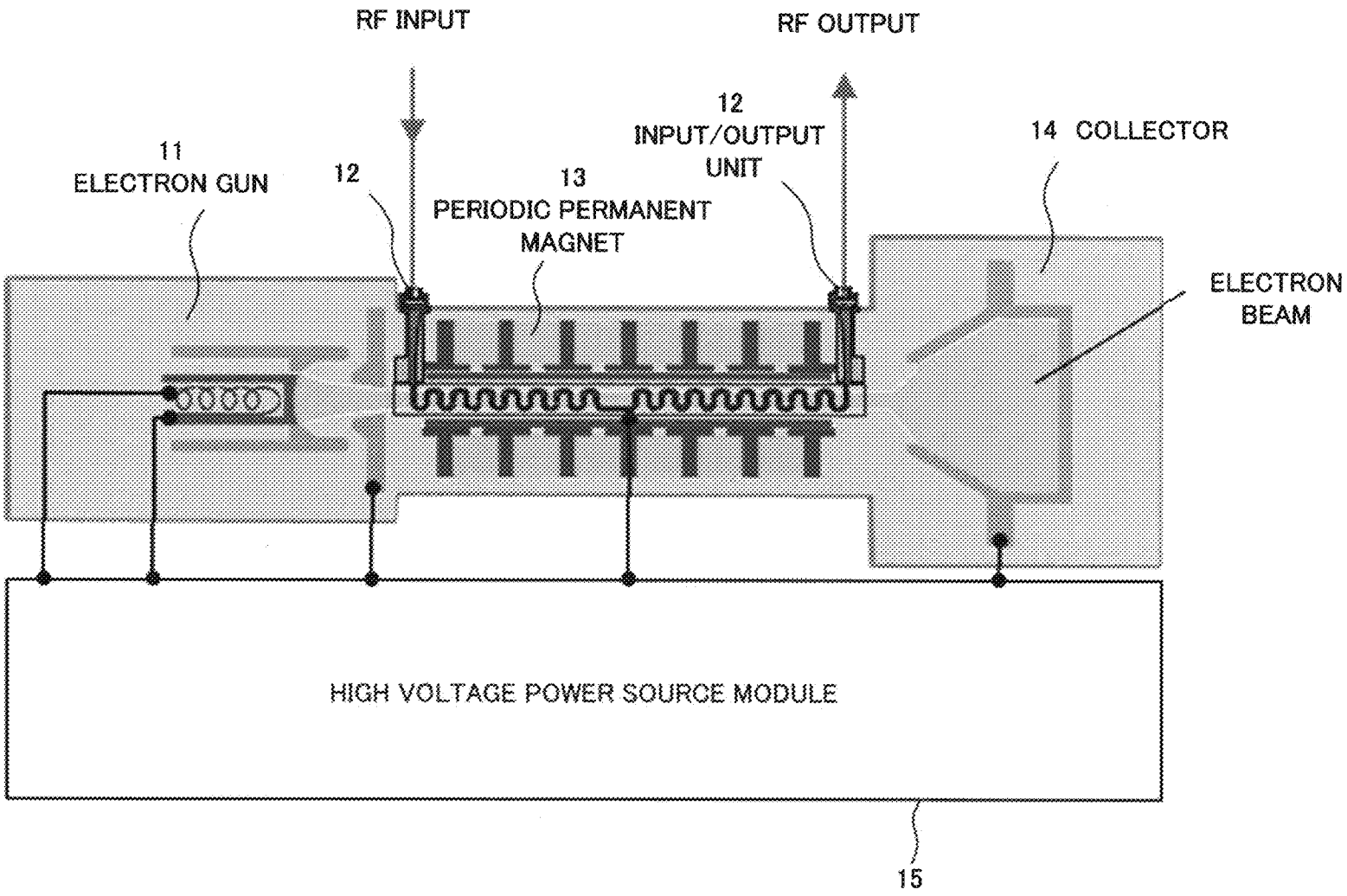
FIG. 8 is an overview diagram for explaining an internal structure of the traveling wave tube using the folded waveguide type slow wave circuit according to one embodiment of the present invention, and a high voltage power source module that supplies voltage to the traveling wave tube.

FIG. 7 is an overview diagram for explaining a traveling wave tube using the folded waveguide type slow wave circuit according to one embodiment of the present invention. FIG. 8 is an overview diagram for explaining an internal structure of the traveling wave tube using the folded waveguide type slow wave circuit according to one embodiment of the present invention, and a high voltage power source module that supplies voltage to the traveling wave tube.

The traveling wave tube of FIG. 7 and FIG. 8 includes an electron gun 11 that generates an electron beam, a slow wave circuit serving as the slow wave circuit of the aforementioned embodiment and allowing the electron beam and a high frequency signal to interact with each other, and a collector 14 that captures the electron beam after the interaction is ended. The traveling wave tube of FIG. 7 further includes an input/output unit 12 that inputs/outputs the aforementioned high frequency signal and a magnetic field converging device arranged in the vicinity of the slow wave circuit to suppress spread of the aforementioned electron beam propagating through the slow wave circuit. In the input/output unit 12, radio frequency (RF) input is inputted and RF output is outputted.

Figure 9:
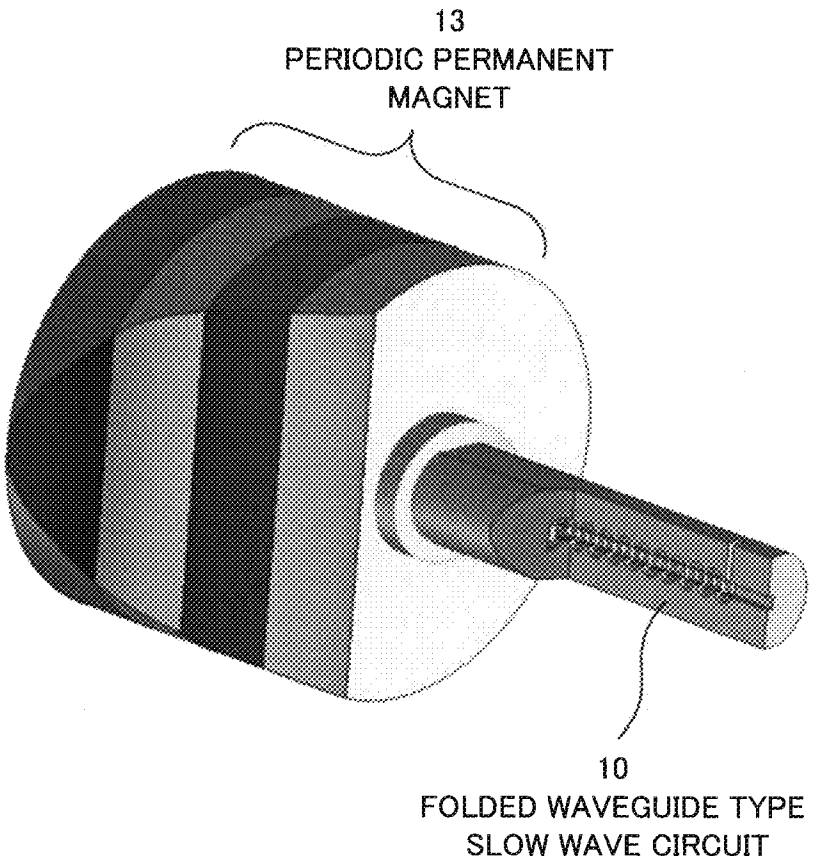
FIG. 9 is an overview diagram for explaining the folded waveguide type slow wave circuit of the traveling wave tube according to one embodiment of the present invention and a periodic permanent magnet.

As the magnetic field converging device, a permanent magnet, an electromagnet, a periodic permanent magnet, which generates a periodic magnetic field for suppressing the spread of the aforementioned electron beam propagating through the slow wave circuit, or the like are considered. The traveling wave tube of FIG. 7 and FIG. 8 uses a periodic permanent magnet 13, which generates a periodic magnetic field for suppressing the spread of the aforementioned electron beam propagating through the slow wave circuit, as an example of the magnetic field converging device. As illustrated in FIG. 8, the traveling wave tube operates by receiving the supply of voltage required for its operation from a high voltage power source module 15. The aforementioned folded waveguide type slow wave circuit 10 is inserted into the periodic permanent magnet 13 as illustrated in FIG. 9. The whole structure, in which the aforementioned folded waveguide type slow wave circuit 10 is inserted into the periodic permanent magnet 13, is also called a slow wave circuit.

FIG. 6 is a sectional view of a slow wave circuit component of a comparative example of the present invention. A beam hole 102 and a folded waveguide 101 are formed in a pair of slow wave circuit components 104. In FIG. 6, the sectional shape of the beam hole 102 is a quadrilateral. The beam hole 102 having a sectional quadrilateral shape is easily manufactured, but the length of a diagonal direction becomes long. Therefore, since a gap from a circle, which is an ideal shape of the beam hole, becomes large, the beam hole unnecessarily increases in size, resulting in narrowness of a frequency band in which an electron beam and a high frequency interact with each other. In a traveling wave tube using the slow wave circuit component of the comparative example, a frequency band with amplification becomes narrow.

EXAMPLES

Example 1

Figure 10:
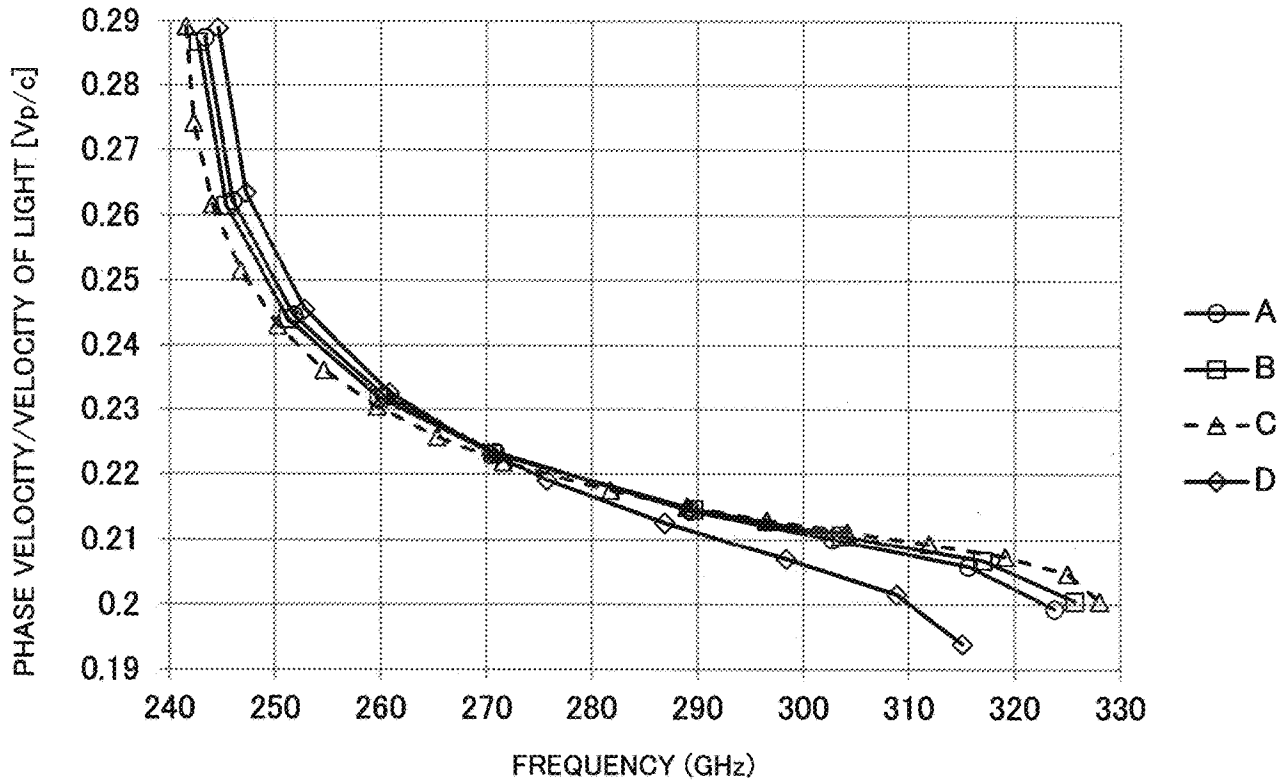
FIG. 10 is a graph illustrating comparison of a sectional shape of a beam hole and performance of a slow wave circuit.

FIG. 10 is a graph illustrating comparison of the performance of a slow wave circuit when a sectional shape of a beam hole is changed. In FIG. 10, the line A illustrates a case where the sectional shape of the beam hole is a hexagon, the line B illustrates a case where the sectional shape of the beam hole is an octagon, the line C illustrates a case where the sectional shape of the beam hole is a circle, and the line D illustrates a case where the sectional shape of the beam hole is a quadrilateral. In the graph, a horizontal axis denotes a frequency (for example, of approximately 300 GHz). A vertical axis denotes a phase velocity Vp of an electron passing through the beam hole and is undimensionalized by the velocity c of light. In the graph, when a flat part is wide, it indicates that an interaction is possible between an electron beam and a high frequency in a wide frequency band. In the case of the circle (the line C), it can be understood that the number of the flattest parts is large and it is possible to achieve a traveling wave tube of a wide bandwidth.

In the quadrilateral, it can be understood that an inclination is large on the whole as compared with the circle and particularly, a gap with the circle becomes large over 280 GHz. In the case of the hexagon (the line A) and the octagon (the line B), it can be understood that they are approximate to the circle. Consequently, in consideration of FIG. 10, when the sectional shape of the beam hole in a direction orthogonal to the longitudinal direction thereof is employed as a polygon having a larger number of sides than that of the quadrilateral, in other words, when the number of sides is increased as compared with the quadrilateral, it can be understood that the performance of the slow wave circuit is improved. Note that, in FIG. 10, the difference between the hexagon and the octagon is small. When the number of sides is small, since manufacturing is facilitated, it can be understood that the hexagon has an advantage as compared with the octagon.

Example 2

Figure 11:
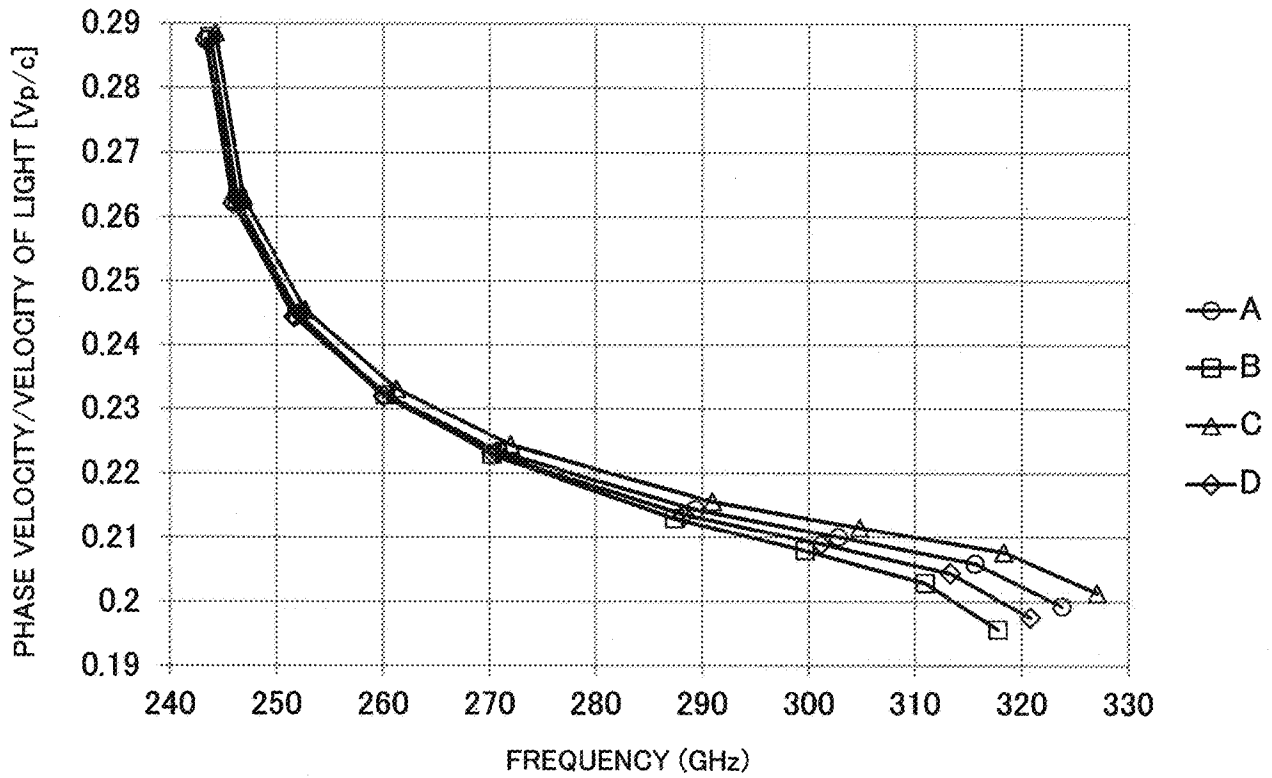
FIG. 11 is a graph illustrating comparison of a shape of a hexagon and performance of a slow wave circuit.

FIG. 11 is a graph illustrating comparison of the shape of a hexagon and the performance of a slow wave circuit. FIG. 11 illustrates a calculation result of the phase velocity Vp when the interior angle $\alpha$ of the beam hole 2 of FIG. 3B is changed. Similarly, to FIG. 10, in FIG. 11, a vertical axis denotes the phase velocity Vp of an electron passing through the beam hole and is undimensionalized by the velocity c of light. The sectional shape of the beam hole 2 of FIG. 3B in the direction orthogonal to the longitudinal direction thereof is a hexagon. In the beam hole 2 having the sectional hexagonal shape, FIG. 11 illustrates a calculation result of the phase velocity when the interior angle $\alpha$ of the beam hole 2 of FIG. 3B is changed. The line A illustrates a case where the interior angle $\alpha$ is 120° and the sectional shape is a regular hexagon. The line B illustrates a case where the interior angle $\alpha$ of FIG. 3B is 160°, the line C illustrates a case where the interior angle $\alpha$ of FIG. 3B is 140°, and the line D illustrates a case where the interior angle $\alpha$ of FIG. 3B is 100°. The regular hexagon is nearest to the circle and transmission properties of an electron beam is expected to be good; however, it can be understood that there is no large difference in the case where the interior angle $\alpha$ is 140°.

Example 3

Figure 12:
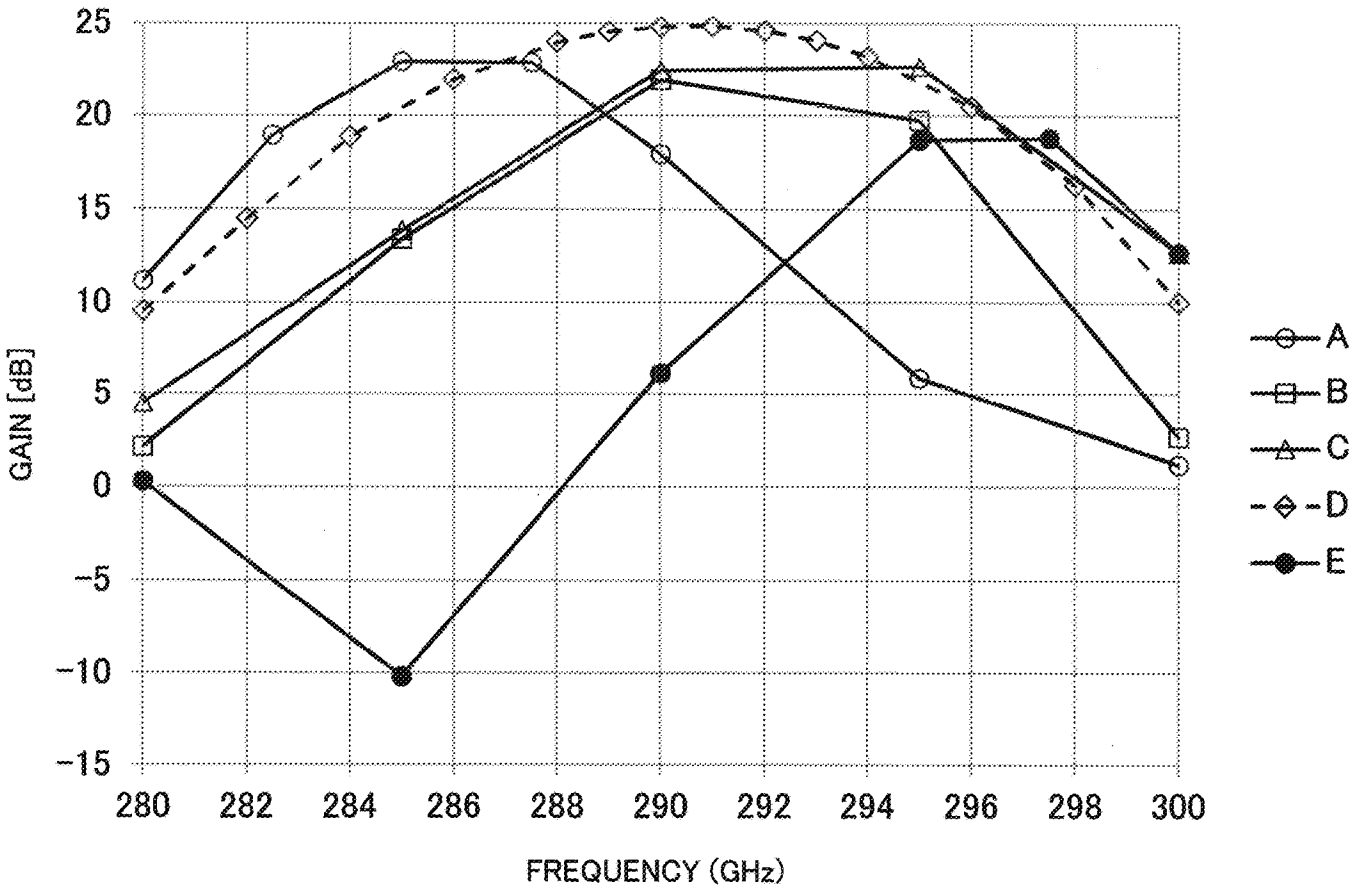
FIG. 12 is a graph illustrating a relation between of a sectional shape of a beam hole and a gain of a slow wave circuit.

FIG. 12 is a graph illustrating a relation between of a sectional shape of a beam hole and a gain of a slow wave circuit. The line A illustrates a case of a hexagon having an interior angle $\alpha$ of 140°, the line B illustrates a case of a regular hexagon, the line C illustrates a case of an octagon, the line D illustrates a case where of a circle, and the line E illustrates a case where of a quadrilateral. When a target gain is set to 20 dB, it can be understood that the circle exceeds 20 dB in a frequency bandwidth of about 10 GHz at a frequency of around 290 GHz. When the frequency bandwidth is set to 1, frequency bandwidth of the regular octagon is 0.7, frequency bandwidth of the regular hexagon is 0.6, frequency bandwidth of the hexagon having $\alpha$ of 140° is 0.6, and frequency bandwidth of the quadrilateral is 0.2. When the beam hole is manufactured by the LIGA manufacturing technology or the like, since a metal is deposited through stacking in the up and down direction of FIG. 2, it is easy to manufacture a sectional shape which has a large interior angle $\alpha$ and is near a quadrilateral. As above, it can be understood that it is advantageous to employ a hexagon having an interior angle $\alpha$ larger than 120°. In other words, it is advantageous to manufacture a beam hole having a sectional shape in which an interior angle $\alpha$ formed by both sides of one apex of a hexagon is larger than 120°.

So far, preferred example embodiments and examples of the present invention have been described; however, the present invention is not limited thereto. For example, it is sufficient if a polygon, which is the sectional shape of the beam hole in the direction orthogonal to the longitudinal direction thereof and has a larger number of sides than that of a quadrilateral, forms such a shape on the whole. For example, the present invention includes a polygon in which each corner constituting a polygonal shape of the beam hole becomes dull and serves as a smooth surface due to a manufacturing variation, machining accuracy, or a chronological change. Various modifications can be made within the scope of the invention defined in the appended claims, and it goes without saying that they are included in the scope of the present invention.

So far, the present invention has been described employing the aforementioned embodiments as exemplary examples. However, the present invention is not limited to the aforementioned embodiments. That is, the present invention can employ various embodiments which can be understood by a person skilled in the art within the scope of the present invention.

This application is based upon and claims the benefit of priority from Japanese patent application No. 2015-247569, filed on Dec. 18, 2015, the disclosure of which is incorporated herein in its entirety by reference.

REFERENCE SIGNS LIST

1 Folded waveguide
2, 2*a*, 2*b*, 2*c* Beam hole
3 Input/output waveguide
4, 4*a*, 4*b* Slow wave circuit component
5*a*, 5*b*, 6*a*, 6*b* Groove
9 Semicircular component
10 Folded waveguide type slow wave circuit
11 Electron gun
12 Input/output unit
13 Periodic permanent magnet
14 Collector
15 High voltage power source module

What is claimed is:

1. A slow wave circuit comprising:

a meandering waveguide of a folded structure comprising an opposing meandering groove formed in a flat surface of opposing components; and a beam hole formed between the opposing groove of the opposing components and that pierces the meandering waveguide, wherein a sectional shape of the beam hole in a direction orthogonal to a longitudinal direction thereof is a polygon having a larger number of sides as compared with a quadrilateral.

2. The slow wave circuit according to claim 1, wherein the polygon is formed such that an apex of the polygon is positioned in a direction in which the meandering waveguide crosses the beam hole.

3. The slow wave circuit according to claim 1, wherein, in the polygon, the sectional shape of the beam hole is line symmetric in a first direction and is line symmetric in a second direction different from the first direction.

4. The slow wave circuit according to claim 1, wherein an interior angle formed by both sides of an apex of the polygon is larger than 120°.

5. The slow wave circuit according to claim 1, wherein the polygon includes a hexagon.

6. The slow wave circuit according to claim 1, wherein the polygon is a regular hexagon.

7. The slow wave circuit according to claim 1, wherein the polygon is an octagon.

8. The slow wave circuit according to claim 1, further comprising:

a magnetic field converging device that suppresses spread of the electron beam propagating through the beam hole.

9. A traveling wave tube comprising:

an electron gun that generates an electron beam;

the slow wave circuit including a meandering waveguide of a folded structure comprising an opposing meandering groove formed in a flat surface of opposing components and a beam hole formed between the opposing groove of the opposing components and that pierces the meandering waveguide, which allows the electron beam and a high frequency signal to interact with each other; and a collector that captures the electron beam after interaction is ended, wherein a sectional shape of the beam hole in a direction orthogonal to a longitudinal direction thereof is a polygon having a larger number of sides as compared with a quadrilateral.

10. The traveling wave tube according to claim 9, further comprising:

a magnetic field converging device arranged in the vicinity of the slow wave circuit to suppress spread of the electron beam propagating through the slow wave circuit.

11. The traveling wave tube according to claim 9, wherein the polygon is formed such that an apex is positioned in a direction in which the waveguide crosses the beam hole.

12. The traveling wave tube according to claim 9, wherein, in the polygon, the sectional shape of the beam hole is line symmetric in a first direction and is line symmetric in a second direction different from the first direction.

13. The traveling wave tube according to claim 9, wherein an interior angle formed by both sides of an apex of the polygon is larger than 120°.

14. The traveling wave tube according to claim 9, wherein the polygon includes a hexagon.

15. The traveling wave tube according to claim 14, wherein the polygon is a regular hexagon.

16. The traveling wave tube according to claim 9, wherein the polygon is an octagon.

* * * * *